United States Patent [19]

Bower et al.

[11] 4,311,417

[45] Jan. 19, 1982

[54] MINE ROOF SUPPORT

[75] Inventors: Lewis R. B. Bower; Arthur Scarfe; John C. Smith, all of Horbury, England

[73] Assignee: Fletcher Sutcliffe Wild Limited, Horbury, England

[21] Appl. No.: 115,385

[22] Filed: Jan. 25, 1980

[30] Foreign Application Priority Data

Feb. 3, 1979 [GB] United Kingdom ..... 03868/79

[51] Int. Cl.[3] ..... E21D 23/04

[52] U.S. Cl. ..... 405/297

[58] Field of Search ..... 405/291, 297

[56] References Cited

U.S. PATENT DOCUMENTS 3,748,861 7/1973 Groetschel ..... 405/297
3,990,251 11/1976 Wehner et al. ..... 405/291
4,139,325 2/1979 Bower et al. ..... 405/291

FOREIGN PATENT DOCUMENTS 1378513 12/1974 United Kingdom .
1503750 3/1978 United Kingdom .

*Primary Examiner*—Ernest R. Purser
*Attorney, Agent, or Firm*—Trexler, Bushnell & Wolters, Ltd.

[57] ABSTRACT

A self-advancing, hydraulically powered mine roof support comprises a base means, a double-acting hydraulic advancing ram extending in the intended direction of advance of the support in use, the cylinder of the advancing ram being located towards the forward end of the support and the piston rod of the advancing ram being located towards the rearward end of the support, a lifting ram mounted on the support at or towards the forward end thereof and being operable on the periphery of the cylinder to lift the forward end with respect to the cylinder, the end of the cylinder remote from the piston rod being connectable to a pan of an armoured conveyor, and the advancing ram being connected to the support by an inclined link means pivotally attached to the base means and to the piston rod.

6 Claims, 3 Drawing Figures

MINE ROOF SUPPORT

This invention relates to a hydraulically powered, self-advancing mine roof support and in particular to a base means thereof.

Such supports are commonly used in conjunction with an armoured conveyor as part of mineral winning operations, the conveyor being made up of a plurality of pans secured together end-to-end in articulated manner. In longwall mining practice, the pans are advanced in accordance with the rate of mineral extraction and this advance is effected by providing at least one double-acting hydraulic ram in a base means of a support, the ram being actuable in a first direction to advance the conveyor from the support and actuable in a second direction to advance the support towards the conveyor. However, during advance of the support, the leading end of the base means may be obstructed, e.g. by a rock formation and/or debris and/or may be engaged in a recess in the floor if relatively soft floor conditions are involved. Various proposals have been made for lifting the forward end of the base member so as to obviate the effect on advancement of any such obstructions, one such proposal being described in our British Pat. No. 1,503,750 for instance.

According to the present invention there is provided a self-advancing, hydraulically powered mine roof support comprising a base means, a double-acting hydraulic advancing ram extending in the intended direction of advance of the support in use, the cylinder of the advancing ram being located towards the forward end of the support and the piston rod of the advancing ram being located towards the rearward end of the support, a lifting ram mounted on the support at or towards the forward end thereof and being operable on the periphery of the cylinder of the advancing ram to lift the forward end of the base means with respect to that cylinder, the end of that cylinder remote from its piston rod being connectable to a pan of an armoured conveyor, and the advancing ram being connected to the support solely by an inclined link means pivotally attached to the base means and pivotally attached to the piston rod of the advancing ram.

Thus, in use, the forward end of the base means may be elevated from the mine floor, e.g. to clear an obstruction, by extending the lifting ram, the latter reacting on the periphery of the advancing ram cylinder and as the latter is connected at its forward end to a pan, with its rearward end normally lying on the mine floor due to its articulated connection via the link means to avoid bending moments being applied to the piston rod of the advancing ram, the support may then be advanced, by actuation of the advancing ram, with the forward end of the base means clear of the mine floor.

The advancing ram cylinder is preferably provided with a longitudinally extending, planar slide plate engageable by the lifting ram.

Preferably the link means comprises a slotted connection which becomes inclined in certain angular positions of the link means to reduce frictional forces at that connection, thereby reducing any resistance to the advancing ram cylinder—and particularly the end of that cylinder adjacent that connection, finding support from the mine floor. The connection of the other end of the advancing ram cylinder to a pan of the conveyor may also be by a slotted connection. Conveniently, the link means may comprise two cranked link elements, one end of each element being located adjacent one another and connected to opposite sides of the free end of the advancing ram piston rod, and the other ends of each element being spaced apart to clear the advancing ram cylinder.

Furthermore, the link means may be pivotally attached to the base means above the advancing ram cylinder while a stop may be provided to limit the pivotal movement of the link means in circumstances where the end of the advancing ram cylinder adjacent its piston may be located above a hole or depression in the mine floor.

The invention will now be described in greater detail, by way of example, with reference to the accompanying drawings, in which.

Figure 1:
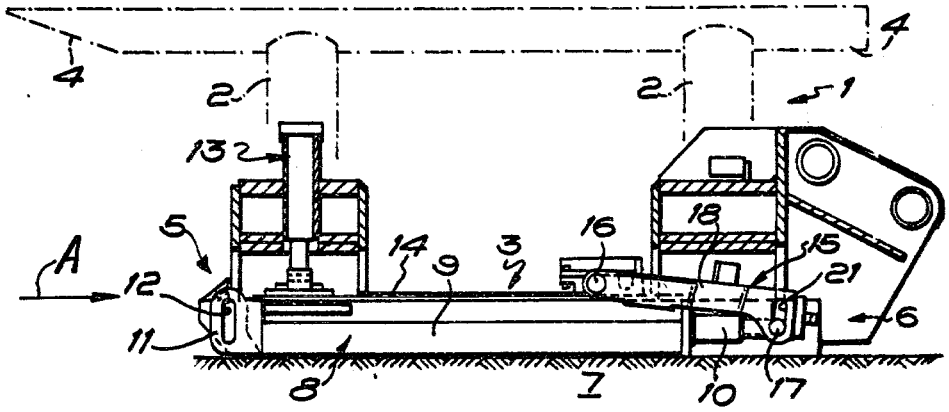
FIG. 1 is a part-sectional side elevation of a mine roof support in accordance with the present invention.
Figure 2:
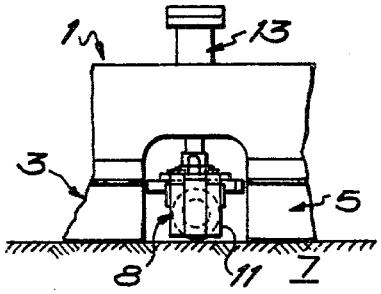
FIG. 2 is a view in the direction of arrow A of FIG. 1.
Figure 3:
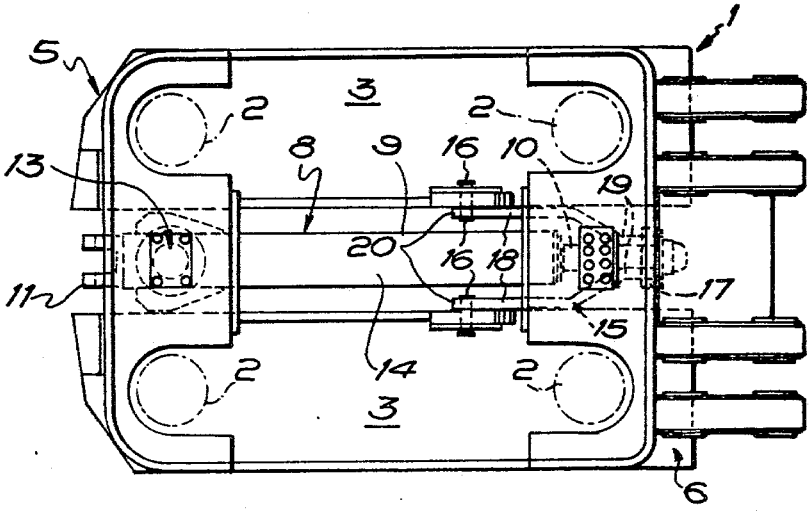
FIG. 3 is a plan view of the base means of FIG. 1.

In the drawings, a self-advancing hydraulically powered, mine roof support 1 comprises four hydraulically extensible chock legs 2 articulated at their lower ends to a base means 3 and at their upper ends to a roof beam 4. The support 1 and the base means 3 have a forward end 5 and a rearward end 6 and seats on a mine floor 7. A double-acting hydraulic advancing ram 8 is located within the base means and extends in the intended direction of advance of the roof support 1, in use—this being from right to left considering FIGS. 1 and 3. The advancing ram 8 comprising a cylinder 9 located towards the forward end 5, and a piston rod 10 located towards the rearward end 6. The cylinder 9 is attachable either directly or indirectly by a connector 11 with a slot 12 to one sidewall of a pan of an armoured conveyor (not shown) extending in the conventional manner along a mineral face and located between the forward end 5 and the mineral face. A lifting ram 13 is mounted on the forward end 5 and is operable upon a planar slide plate 14 carried by the cylinder 9. The advancing ram 8 is connected to the support 1 solely by an inclined link means 15 pivotally attached by pivot pins 16 to the base means 3 at a location above the cylinder 9 and pivotally attached by a pivot pin 17 to the advancing ram 8, the pin 17 being carried by the free end of the piston rod 10. The link means 15 comprises two, cranked link elements 18 to provide ends 19 located adjacent one another and connected to opposite sides of the free end of the piston rod 10 and ends 20 spaced from one another to clear the cylinder 9, each end 19 having a slot 21 to accommodate a portion of the pivot pin 17.

In use, when it is required to advance the support (following the previous advance of the face conveyor) towards the newly exposed mineral face, extension of the lifting ram 13, before actuation of the advancing ram 8, will ensure that the forward end 5 is positively lifted from the mine floor 7 and hence clear of any obstruction that might be present to hinder advance of the support, the reaction of the ram 13 being taken by the cylinder 9 and its slide plate 14, as the cylinder 9 is supported at one end by attachment via the connector 11 to the face conveyor and at the other end on the mine floor 7, the inclined link means 15 allowing that cylinder end to find its own location on the mine floor 7.

What we claim is:

1. A self-advancing, hydraulically powered mine roof support comprising a base means, a double-acting hydraulic advancing ram comprising a cylinder and a piston rod extending in the intended direction of advance of the support in use, said cylinder being located towards a forward end of said support and said piston rod being located towards a rearward end of said support, a lifting ram mounted on said support adjacent said forward end thereof and being operable peripherally on said cylinder to lift said forward end of said base means with respect to said cylinder, an end of said cylinder remote from its piston rod being connectable to a pan of an armoured conveyor, and an inclined link means pivotally attached to said base means and pivotally attached to said piston rod and being the sole means by which said advancing ram is connected to said support.

2. A mine roof support as claimed in claim 1, wherein a longitudinally extending, planar slide plate is provided on said cylinder for engagement by said lifting ram.

3. A mine roof support as claimed in claim 1, wherein said link means comprises a slotted connection.

4. A mine roof support as claimed in claim 1, wherein a slotted connection is provided at the other end of said cylinder for connection of said other end to a pan of the conveyor.

5. A mine roof support as claimed in claim 1, wherein said link means comprises two cranked link elements, one end of each element being located adjacent one another and connected to opposite sides of a free end of said piston rod, and the other ends of each element being spaced apart to clear said cylinder.

6. A mine roof support as claimed in claim 1, wherein said link means is pivotally attached to said base means above said cylinder.

* * * * *